US006675967B2

(12) United States Patent
Huang

(10) Patent No.: US 6,675,967 B2
(45) Date of Patent: Jan. 13, 2004

(54) DETACHABLE TOOL BOX ASSEMBLY

(75) Inventor: Steve Huang, Taichung Hsien (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 0 days.

(21) Appl. No.: 10/138,750

(22) Filed: May 3, 2002

(65) Prior Publication Data

US 2003/0221984 A1 Dec. 4, 2003

(51) Int. Cl.[7] ..... B65D 85/28; B65D 51/04
(52) U.S. Cl. ..... 206/372; 206/373; 220/845
(58) Field of Search ..... 206/45.2, 45.24, 206/372, 373, 378, 751, 752; 220/835, 845, 847, 4.22

(56) References Cited

U.S. PATENT DOCUMENTS 5,603,402 A * 2/1997 Cuneo ..... 206/320
6,082,539 A * 7/2000 Lee ..... 206/373
2003/0010660 A1 * 1/2003 Lai ..... 206/373
2003/0038142 A1 * 2/2003 Gee ..... 220/835

* cited by examiner

*Primary Examiner*—David T. Fidei
(74) *Attorney, Agent, or Firm*—David N. Lathrop, Esq.; Gallagher & Lathrop

(57) ABSTRACT

A tool box assembly includes first and second shell members. The first shell member includes a first shell body, a foldable joining member, and a grip member which includes proximate and distal jaw portions. The second shell member includes a second shell body and a gripped member. The gripped member includes an anchored body and first and second anchored portions. The anchored body forms first and second shoulder portions with the first and second anchored portions, respectively. To interconnect the two shell bodies, the proximate jaw portion is brought to engage the first shoulder portion, and the distal jaw portion is then pressed to slip over the second anchored portion and engage the second shoulder portion, thereby permitting opening and closing of the first and second shell bodies relative to each other by virtue of the foldable joining member.

2 Claims, 5 Drawing Sheets

DETACHABLE TOOL BOX ASSEMBLY

BACKGROUND OF THE INVENTION

1. Field of the Invention

The invention relates to a tool box, more particularly to a detachable tool box assembly with two shell bodies that can be interconnected or detached from each other in a convenient manner.

2. Description of the Related Art

Referring to FIG. 1, a conventional tool box includes upper and lower shell members 1, 2, and a connecting strip 3 interconnecting the upper and lower shell members 1, 2. The upper shell member 1 is provided with a pair of snap fasteners 101. The lower shell member 2 is provided with a pair of fastener-retaining members 201 for retaining releasably the snap fasteners 101. The lower shell member 2 confines a space for receiving a plurality of hand tools (not shown). The connecting strip 3 is integrally formed with the upper and lower shell members 1, 2 via injection molding, and is configured to be flexible such that the upper shell member 1 can be swiveled relative to the lower shell member 2 for opening and closing of the tool box.

When such a tool box is being displayed in a store, the upper shell member 1 has to be opened and turned to one side to reveal the hand tools (not shown) disposed in the lower shell member 2, which will take up a certain amount of space. As the upper shell member 1 is not designed to hold any hand tools therein, the presence of the upper shell member 1 is a waste of the valuable shelf space available in the store.

SUMMARY OF THE INVENTION

Therefore, the main object of the present invention is to provide a detachable tool box assembly which includes shell members that can be detached and interconnected conveniently to facilitate display and use.

Accordingly, a detachable tool box assembly of the present invention comprises a first shell member and a second shell member. The first shell member includes a first shell body, a foldable joining member and a grip member. The first shell body confines a first accommodation space, and has first front and rear side walls spaced apart from each other by the first accommodation space in a first transverse direction, and a first major wall. The first front and rear side walls and the first major wall cooperatively confine the first accommodation space. The foldable joining member includes a proximate lateral portion integrally formed with the first rear side wall and disposed remote from the first major wall, and a distal lateral portion extending from the proximate lateral portion away from the first rear side wall. The grip member includes: an interconnecting body integrally formed with the distal lateral portion and extending away from the proximate lateral portion, the interconnecting body including proximate and distal ends with respect to the distal lateral portion; a proximate jaw portion extending from the proximate end of the interconnecting body and away from the first major wall; and a distal jaw portion extending from the distal end of the interconnecting body and away from the first major wall, the distal jaw portion being disposed to be spaced apart from the proximate jaw portion. The second shell member includes a second shell body and a gripped member. The second shell body confines a second accommodation space, and has second front and rear side walls spaced apart from each other by the second accommodation space in a second transverse direction, and a second major wall. The second front and rear walls, and the second major wall cooperatively confine the second accommodation space. The gripped member includes an anchored body extending from the second rear side wall in the second transverse direction and terminating at a lateral end, and first and second anchored portions which extend respectively from the lateral end and away from each other in a third direction which is transverse to the second transverse direction such that the anchored body forms first and second shoulder portions with the first and second anchored portions, respectively. The first and second anchored portions are disposed remote from and adjacent to the second major wall, respectively, and are configured such that when the proximate jaw portion is brought to engage the first shoulder portion, the distal jaw portion can be pressed to slip over the second anchored portion and engage the second shoulder portion, thereby permitting opening and closing of the first and second shell bodies relative to each other by virtue of bending the foldable joining member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
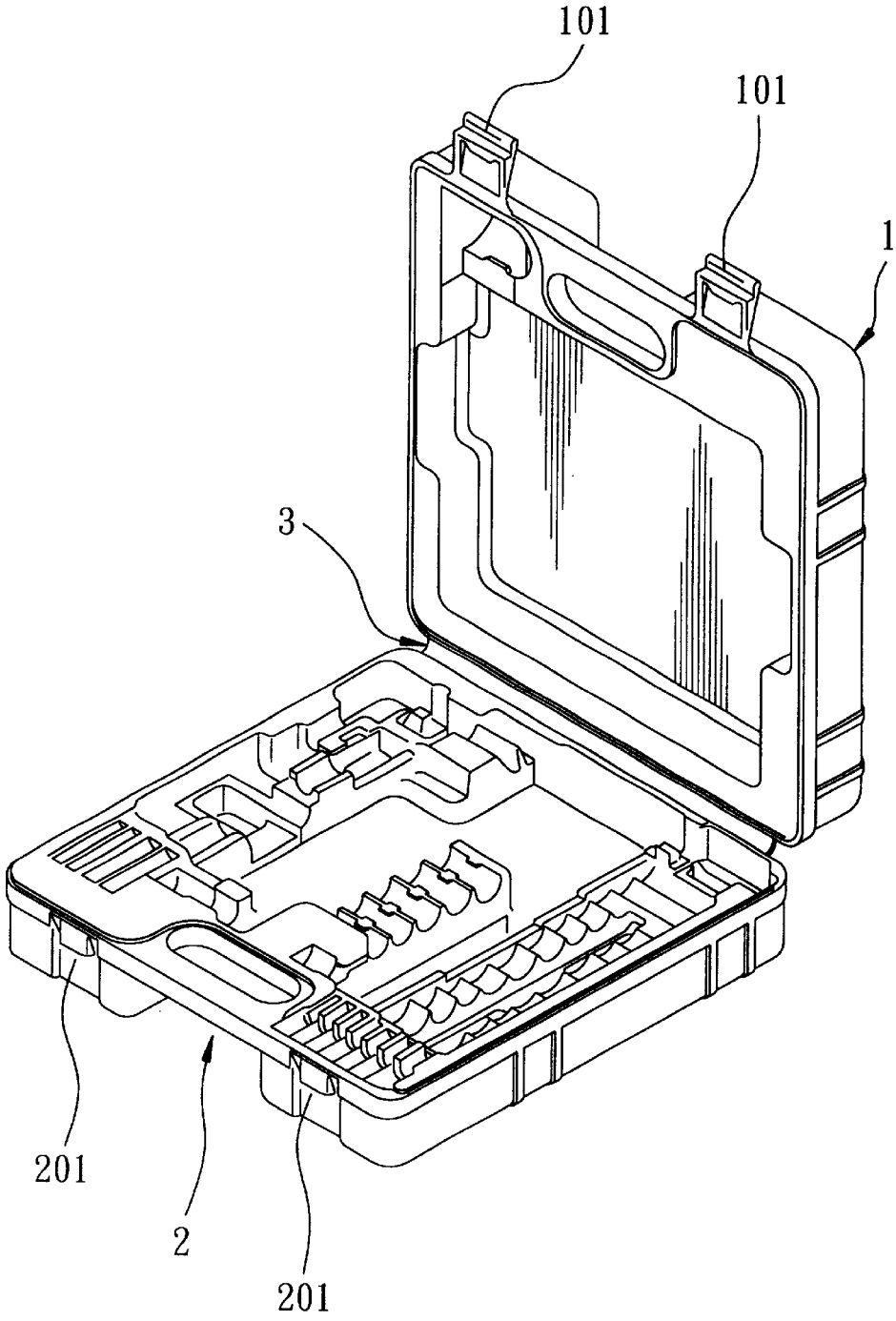
FIG. 1 PRIOR ART
FIG. 1 is a perspective view of a conventional tool box.
Figure 2:
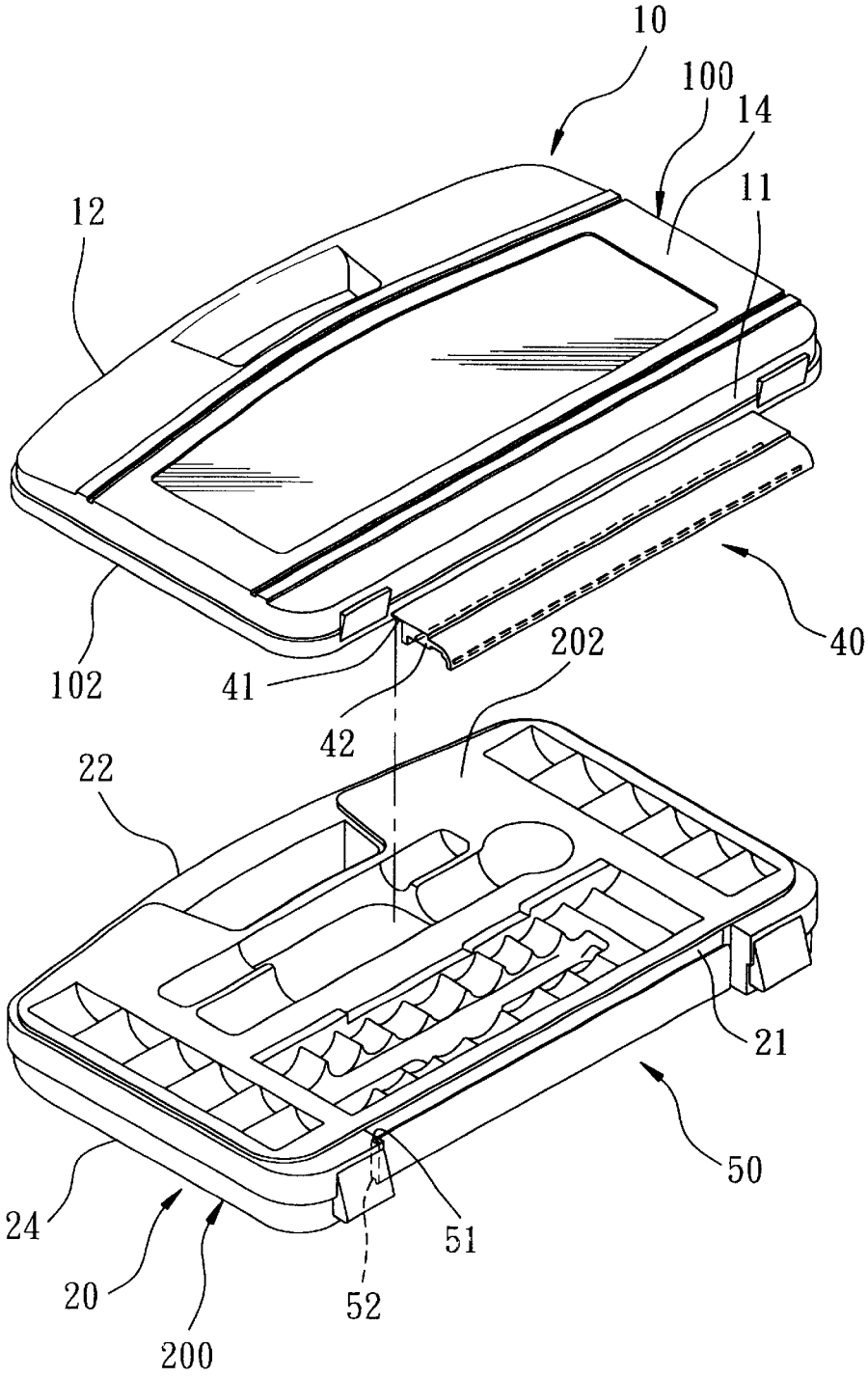
FIG. 2 is an exploded perspective view of a preferred embodiment of a detachable tool box according to the invention.
Figure 3:
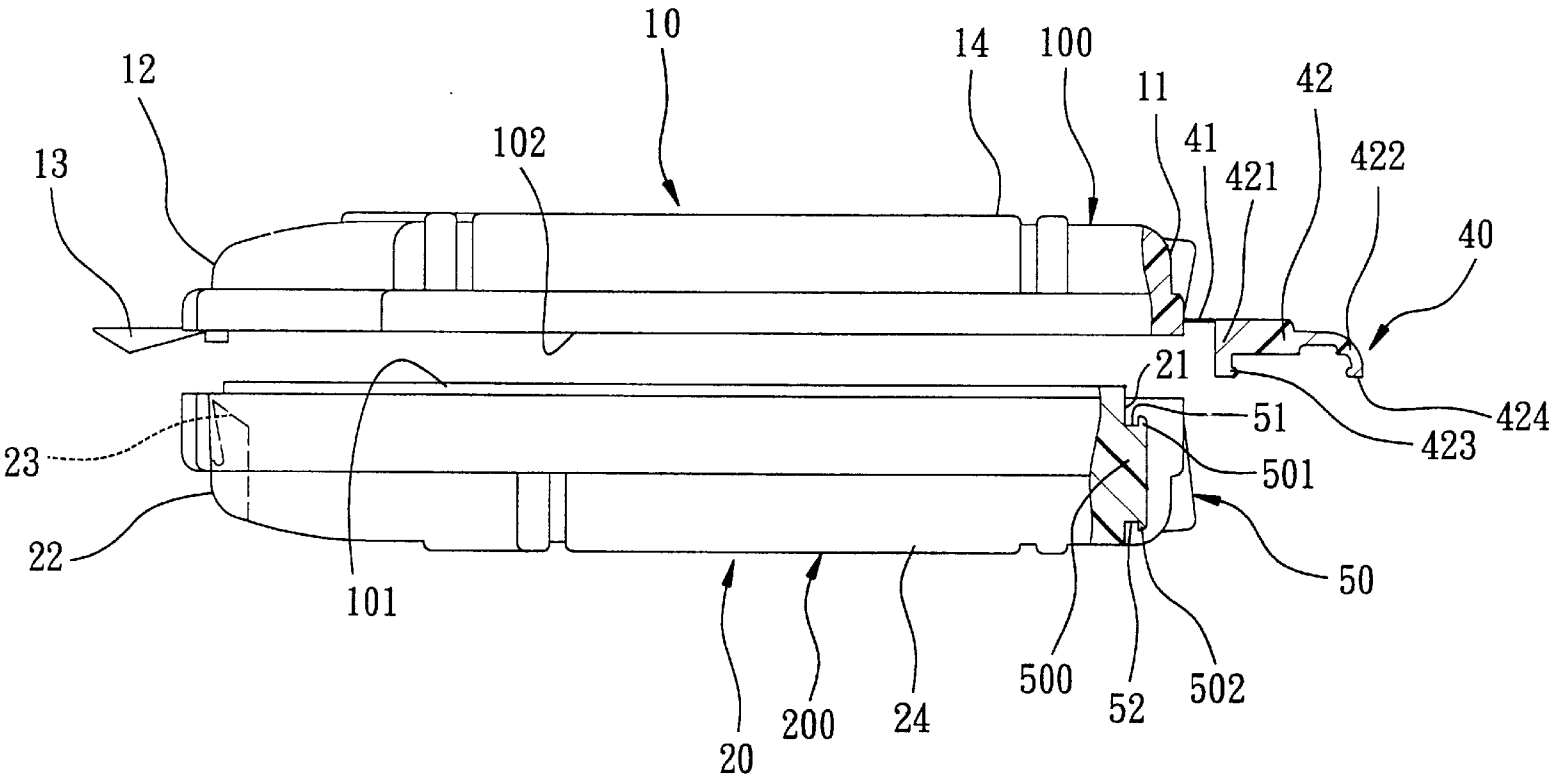
FIG. 3 is a partly sectional schematic side view of the preferred embodiment.

Referring to FIGS. 2 and 3, the preferred embodiment of a detachable tool box assembly according to this invention is shown to include first and second shell members 10, 20, which are preferably molded from a moldable material, such as plastic. The first shell member 10 includes a first shell body 100, a foldable joining member 41 and a grip member 40. The first shell body 100 confines a first accommodation space 102, and has first front and rear side walls 12, 11 spaced apart from each other by the first accommodation space 102 in a first transverse direction, and a first major wall 14. The first front and rear side walls 12, 11 and the first major wall 14 cooperatively confine the first accommodation space 102. The foldable joining member 41 includes a proximate lateral portion integrally formed with the first rear side wall 11 and disposed remote from the first major wall 14, and a distal lateral portion extending from the proximate lateral portion away from the first rear side wall 11. The grip member 40 includes an interconnecting body 42 integrally formed with the distal lateral portion and extending away from the proximate lateral portion. The interconnecting body 42 includes proximate and distal ends 421, 422 with respect to the distal lateral portion. A proximate jaw portion 423 extends from the proximate end 421 of the interconnecting body 42 and away from the first major wall 14. A distal jaw portion 424 extends from the distal end 422 of the interconnecting body 42 and away from the first major wall

104. The distal jaw portion 424 is disposed to be spaced apart from the proximate jaw portion 423. In this embodiment, each of the proximate and distal jaw portions 423, 424 is provided with a longitudinally extending engaging strip that projects toward the other one of the proximate and distal jaw portions 423, 424. The distal end 422 is configured to have a thickness smaller than that of the proximate end 421 so that the distal end 422 is flexible to a certain extent.

The second shell member 20 includes a second shell body 200 and a gripped member 50. The second shell body 200 confines a second accommodation space 202, and has second front and rear side walls 22, 21 spaced apart from each other by the second accommodation space 202 in a second transverse direction, and a second major wall 24. The second front and rear walls 22, 21 and the second major wall 24 cooperatively confine the second accommodation space 202. The gripped member 50 includes an anchored body 500 extending from the second rear side wall 21 in the second transverse direction and terminating at a lateral end. First and second anchored portions 501, 502 extend respectively from the lateral end and away from each other in a third direction which is transverse to the second transverse direction such that the anchored body 500 forms first and second shoulder portions 51, 52 with the first and second anchored portions 501, 502, respectively. The first and second anchored portions 501, 502 are disposed remote from and adjacent to the second major wall 24, respectively.

In the preferred embodiment, two snap fasteners 13 (only one is shown in the drawings) are provided on the first front side wall 12 of the first shell body 100, and two fastener-retaining members 23 (only one is shown) are provided on the second front side wall 22 of the second shell body 200 for fastening front ends of the first and second shell members 10, 20 after the first and second shell bodies 100, 200 are interconnected.

Figure 4:
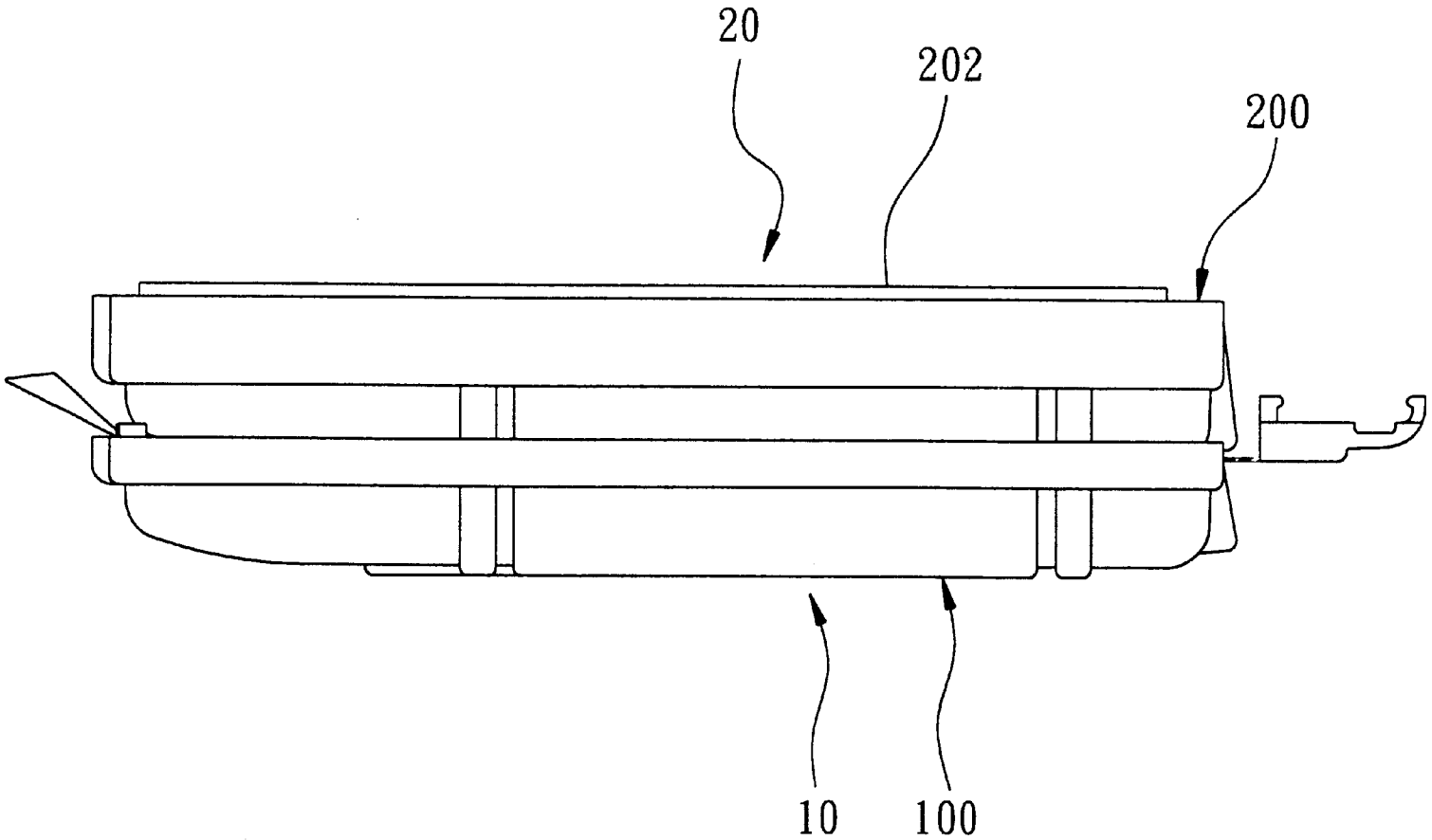
FIG. 4 is a schematic view illustrating stacking of upper and lower shell members of the preferred embodiment.

By virtue of the aforesaid construction, when the tool box assembly containing hand tools (not shown) are being displayed in a store, the first and second shell members 10, 20 can be stacked as shown in FIG. 4, and the hand tools (not shown) can be displayed in the first or second accommodation space 102, 202 of an upper one of the first and second shell bodies 100, 200, thereby achieving the advantage of space-saving.

Figure 5:
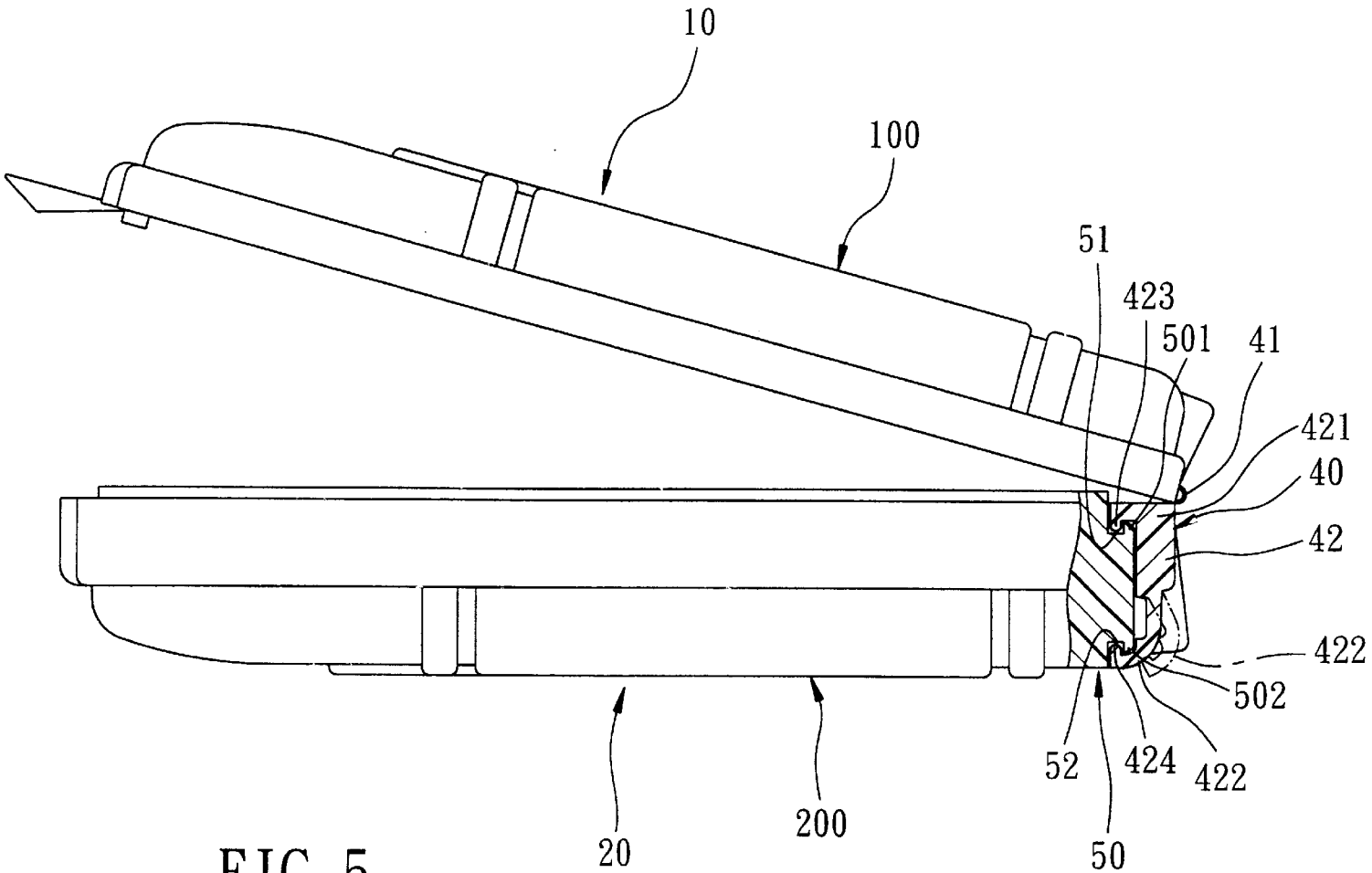
FIG. 5 is a partly sectional schematic side view of the preferred embodiment in an assembled state.

Referring to FIG. 5, the grip member 40 and the gripped member 50 can be inter-engaged to interconnect the first and second shell bodies 100, 200. Due to the configuration of the grip member 40 and the gripped member 50, when the proximate jaw portion 423 is brought to engage the first shoulder portion 51, the distal jaw portion 424, which is flexible, can be pressed to slip over the second anchored portion 502 and engage the second shoulder portion 52, thereby permitting opening and closing of the first and second shell bodies 100, 200 relative to each other by virtue of bending the foldable joining member 41.

In sum, the shell bodies 100, 200 of the tool box assembly of the present invention can be stacked for purposes of saving space when the tool box assembly is employed in a store to display hand tools therein. The shell bodies 100, 200 can also be conveniently interconnected by the user in actual use.

While the present invention has been described in connection with what is considered the most practical and preferred embodiment, it is understood that this invention is not limited to the disclosed embodiment but is intended to shell various arrangements included within the spirit and scope of the broadest interpretation so as to encompass all such modifications and equivalent arrangements.

I claim:

1. A detachable tool box assembly, comprising:

a first shell member including:

a first shell body which confines a first accommodation space and which has first front and rear side walls spaced apart from each other by said first accommodation space in a first transverse direction, and a first major wall, said first front and rear side walls and said first major wall cooperatively confining said first accommodation space;

a foldable joining member including a proximate lateral portion integrally formed with said first rear side wall and disposed remote from said first major wall, and a distal lateral portion extending from said proximate lateral portion away from said first rear side wall; and a grip member including an interconnecting body integrally formed with said distal lateral portion and extending away from said proximate lateral portion, said interconnecting body including proximate and distal ends with respect to said distal lateral portion, a proximate jaw portion extending from said proximate end of said interconnecting body and away from said first major wall, and a distal jaw portion extending from said distal end of said interconnecting body and away from said first major wall, said distal jaw portion being disposed to be spaced apart from said proximate jaw portion; and a second shell member including:

a second shell body which confines a second accommodation space, and which has second front and rear side walls spaced apart from each other by said second accommodation space in a second transverse direction, and a second major wall, said second front and rear walls and said second major wall cooperatively confining said second accommodation space; and a gripped member including an anchored body extending from said second rear side wall in the second transverse direction and terminating at a lateral end, and first and second anchored portions which extend respectively from said lateral end and away from each other in a third direction which is transverse to said second transverse direction such that said anchored body forms first and second shoulder portions with said first and second anchored portions, respectively, said first and second anchored portions being disposed remote from and adjacent to said second major wall, respectively, and being configured such that when said proximate jaw portion is brought to engage said first shoulder portion, said distal jaw portion can be pressed to slip over said second anchored portion and engage said second shoulder portion, thereby permitting opening and closing of said first and second shell bodies relative to each other by virtue of bending said foldable joining member.

2. The detachable tool box assembly as claimed in claim 1, wherein each of said first and second shell members is integrally formed from a moldable material.

* * * * *